US005091102A

United States Patent [19]

Sheridan

[11] Patent Number: 5,091,102

[45] **Date of Patent: * Feb. 25, 1992**

[54] METHOD OF MAKING A DRY ANTIMICROBIAL FABRIC

[75] Inventor: Christopher H. Sheridan, Cresskill, N.J.

[73] Assignee: Nordico, Inc., New York, N.Y.

[ * ] Notice: The portion of the term of this patent subsequent to Aug. 7, 2007 has been disclaimed.

[21] Appl. No.: 563,561

[22] Filed: Aug. 3, 1990

Related U.S. Application Data

[63] Continuation-in-part of Ser. No. 271,320, Nov. 15, 1988, Pat. No. 4,946,617.

[51] Int. Cl.[5] ..... C11D 11/00; C11D 1/62; C11D 1/835; C11D 17/06

[52] U.S. Cl. ..... 252/91; 252/90; 252/106; 252/153; 252/171; 252/174; 252/174.21; 252/547; 252/DIG. 10; 424/404; 424/409; 424/414; 423/236; 423/245; 423/289

[58] Field of Search ..... 252/90, 91, 92, 106, 252/134, 174, 174.21, 547, 171; 15/209 R; 206/812; 424/404, 409, 414; 428/236, 245, 289

[56] References Cited

U.S. PATENT DOCUMENTS

| | | | |
|---|---|---|---|
| 3,227,614 | 1/1966 | Sheuer | 167/84 |
| 3,283,357 | 1/1966 | Decker | 15/506 |
| 3,786,615 | 1/1974 | Bauer | 53/471 |
| 3,839,234 | 10/1974 | Roscoe | 252/544 |
| 3,895,474 | 7/1975 | Bauer | 53/471 |
| 3,897,356 | 7/1975 | Pociluyko | 252/91 |
| 4,203,872 | 5/1980 | Flanagan | 252/542 |
| 4,257,924 | 3/1981 | Chester | 252/547 |
| 4,443,363 | 4/1984 | Klinger et al. | 252/547 |
| 4,448,704 | 5/1984 | Barby et al. | 252/91 |
| 4,587,154 | 5/1986 | Hotchkiss et al. | 428/195 |
| 4,624,890 | 11/1986 | Lloyd et al. | 428/20 |
| 4,666,621 | 5/1987 | Clark et al. | 252/91 |
| 4,692,374 | 9/1987 | Bouchette | 428/288 |
| 4,946,617 | 8/1990 | Sheridan et al. | 252/91 |

FOREIGN PATENT DOCUMENTS

| | | |
|---|---|---|
| 7244087 | 5/1987 | Australia . |
| 1056656 | 3/1986 | Japan . |
| 0760232 | 10/1956 | United Kingdom . |

*Primary Examiner*—Paul Lieberman
*Assistant Examiner*—A. Beadles-Hay
*Attorney, Agent, or Firm*—Rosen, Dainow & Jacobs

[57] ABSTRACT

A method for making a substantially flexible dry matrix and the result and article capable of cleaning a surface by removing dust and/or organic film and rendering the surface substantially static-free, suitable for use as a garment, air filter or mat, comprising a matrix comprising natural or synthetic, woven, non-woven or knitted fibers, or a flexible foam material, said matrix having been uniformly coated with an amount of treatment solution sufficient to allow said matrix to retain its substantially dry characteristics, said solution comprising between about 25% and 75% of at least one glycol compound, between about 0.2% and 60% of a cationic surfactant, an antimicrobial compound and optionally up to about 45% of a nonionic surfactant may be added to the treatment solution. When removing organic film, the wipe is contacted with water and used to wash the surface, and can then be rung out and used to wipe the surface dry.

58 Claims, No Drawings

METHOD OF MAKING A DRY ANTIMICROBIAL FABRIC

This application is a Continuation-in-Part application of Ser. No. 07/271,320, filed Nov. 15, 1988, now U.S. Pat. No. 4,946,617.

FIELD OF THE INVENTION

The present invention relates to a matrix capable of being converted into a substantially dry wipe which has incorporated therein a mixture comprising at least one glycol compound and a cationic surfactant and optionally a nonionic surfactant. The dry wipe of the present invention can be used for a variety of different applications. For example, it can be used as a dust cloth to pick up and remove dust, fibers and other particulate matter while concurrently rendering the surface clean and substantially static free; in addition, the aforementioned wipe if immersed in water, acts as a hard surface cleaning wiper while concurrently rendering the cleaned surface substantially static free; with the appropriate additives it can be used in antimicrobial applications, which includes by way of illustration being formed into an antimicrobial garment, an antimicrobial air filter or an antimicrobial mat.

BACKGROUND OF THE INVENTION

One of the cleaning systems for "hard surfaces" (i.e., as exemplified by formica counter tops and table tops, computer screens, kitchen appliances, porcelain bathroom surfaces) have used solid or liquid soap, and currently preferably used detergents, which were applied to the surface with or without some scrubbing means.

In the past, liquid cleaners generally contained an active surfactant in addition to water, buffers, preservatives, thickeners, etc. Some of these liquid cleaners are designed to be diluted at the time of use with the dilution factors often being in the range of from 50 to 1 to 100 to 1.

Liquid cleaners were eventually modified to be used in the form of an aerosol or non-aerosol foam. The foams did not require dilution and therefore delivered more active cleaning chemicals to the surface to be cleaned. The action of the foam itself purportedly obviated the need to "scrub" the surface, however, these foams have not always worked as intended.

Another of the systems for cleaning hard surfaces comprised the use of scrubbing powders, such as sodium bicarbonate, as a carrier for the liquid surfactants used. These powders were diluted with fillers and various abrasive compounds. With the addition of a powdered bleaching agent to the abrasive powders, they gained a reputation of heavy-duty hard surface cleaning.

The difficulty experienced in the prior art with the above-mentioned liquids, foams and powders to achieve a hard surface cleaning was to get the active ingredient to the specific area of the surface to be cleaned in full strength.

Obviously, the aforementioned systems were all liquid systems and would not be efficient for instances where it is desired merely to remove dust from the hard surface. The removal of dust from a hard surface depends upon an entirely different type of system, usually a system wherein, for example, a cloth is impregnated with oil or some other dust removing agent. These dust-removing agents, while demonstrating a capacity to remove dust, are invariably incompatible with water so that the wet-dry systems mentioned above are mutually exclusive with respect to their use.

OBJECT OF THE INVENTION

It is a principal object of the present invention to provide a hard surface cleaning system wipe which can be used dry to pick up and remove dust while rendering that surface static free, and alternatively, with the addition of water to the wipe, to provide a cleaning system which can remove surface films which are predominately organic in nature.

It is another object of the invention to provide a cleaning system which is totally compatible with water while retaining its fully active properties regardless of whether the application is to remove dirt (dry system) or organic film (wet system).

SUMMARY OF THE INVENTION

The present invention relates to a matrix capable of being converted into a substantially flexible dry wipe capable of cleaning a hard surface by removing dust, organic film or both and rendering it substantially static free; alternatively the matrix can be converted into an antimicrobial garment, an antimicrobial air filter or an antimicrobial mat. In each instance cited, the matrix or substrate, (referred to herein as the "matrix") is made up of natural or synthetic fibers, processed into woven, non-woven or knitted forms, a flexible foam material, or any combinations thereof, which matrix is uniformly coated with a treatment solution in an amount sufficient to obtain the benefits of the invention and yet still feel dry to the touch since no water is added other than that naturally present in the matrix. Likewise no water is added to the treatment solution. With the aforementioned criteria in mind, the treatment solution applied can range between about 1 and 99%, preferably between about 3% and 25%, of basis weight of the matrix, said solution comprising between about 25% and 75% of at least one glycol compound, between 0.2% and 60% of a cationic surfactant, and optionally between about 5% and 45% of a nonionic surfactant. When the wipe, after manufacture is used to remove organic film, it must be first contacted with water by immersion or any other means irrespective of whether only the cationic surfactant or the cationic and nonionic surfactants are present in the wipe. Further, the solution may also optionally contain effective amounts of one or more fragrances, preferably between about 0.1% and 5% fragrance.

Such prior art references as U.S. Pat. Nos. 3,227,614, 3,283,357, 4,257,924, 4,692,374 and Australian Patent No. 72440/87 disclose systems of diluting active disinfectants and cleaning agents in a carrier, applying the surplus of the carrier containing the active ingredients onto a specific applicator material and subsequently drying the material with the carrier and active ingredient. These methods were used in the prior art because it was a convenient way to evenly disperse a specific amount of active ingredient on an applicator material.

For example, U.S. Pat. No. 3,227,614 uses a mineral oil as a carrier and adds an excess of detergent to counteract and emulsify the oily properties of the mineral oil carrier. The other references noted above use water, alcohol or combinations thereof, all followed by a drying step.

The product and method of the present invention is simpler, less expensive and applicable to a broader variety of matrix webs. Unexpectedly, the article of the present invention is safer than prior art products since it is practically non-irritating to the eyes, skin, etc.

DESCRIPTION OF THE PREFERRED EMBODIMENT

For the purpose of this specification, the term "substantially dry matrix" as used herein refers to a matrix to which no water has been added other than the water naturally present in the matrix as manufactured. The term further encompasses a finished product, i.e. a wipe, garment or air filter which has been treated with a nonaqueous 100% active solution containing the components described hereinafter which are applied to the matrix or web in such a way as to result in a product that feels dry to the touch.

As noted above, the matrix comprising the substantially dry product made in accordance with the method of the present invention contains natural or synthetic fibers, processed into woven, nonwoven or knitted form, a flexible foam, or combinations thereof, in a basis weight range generally of 5 to 200 grams per square yard, preferably 15 to 100 grams per square yard. A suitable matrix of the present invention is comprised of woven or nonwoven thermoplastic filaments or fibers, more preferably polypropylene, in a basis weight range of 5 to 100 grams per square yard, preferably 15 to 40 grams per square yard, wherein the same filaments or fibers have a diameter preferably less than 4 microns. The tensile strength cf the matrix of the present invention is of sufficient magnitude so as to enable the wipe to be used wet without shredding or disintegrating. It can be generally characterized by a tensile strength of between about 0.5 and 1.5 pounds per inch of width, although obviously, lesser or greater values can be utilized. Such matrix can consist of a single layer of the filaments or fibers described above or a foam layer, or it can consist of a plurality of layers of the same said filaments or fibers and/or foam which have been adhered using any suitable method, such as sonic, thermal or mechanical bonding, etc. The aforementioned blends of the same or different types of fibers may be incorporated into the matrix depending upon the desired end use of the product. Selection of the matrix used pursuant to the present invention is dependent upon the cleaning efficiency or the type of application desired or both. Some factors to be considered with respect to the application to which the matrix will be put are the abrasive characteristics, absorbability characteristics, the porosity of the matrix and, obviously, the cost. In instances where a substantial capacity to hold liquid while in use in accordance with the present invention is desired, a flexible foamed material having high absorptive properties may be used, alone or in combination with the other materials noted above, as the matrix.

Of particular interest for use in the matrix are the following: (a) fibers: polypropylene, polyester, nylon and cellulosics, such as cellulose, cotton, rayon, hemp, etc.; (b) foams: polyurethane, polypropylene, polyethylene, polyester, polyethers, etc.

The cationic surfactant compound employed in the present invention can be selected from any of the well-known classes of water-soluble quaternary ammonium compounds. Such classes include the quaternary heteronium compounds such as cetyl pyridinium chloride and polymeric quaternary ammonium compounds of the general formula:

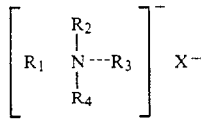

wherein $R_1$ and $R_2$ are selected from an alkyl group, an alkyl ether group and a hydroxyalkyl group each containing from 1 to 3 carbon atoms, $R_3$ is an alkyl group containing from 6 to 20 carbon atoms, and $R_4$ is selected from an alkyl group containing 6 to 20 carbon atoms, an aralkyl group wherein alkyl contains 1 to 2 carbon atoms and heterocyclic radicals, and $X^-$ is a suitable anion such as halide, e.g., chloride, bromide and iodide or nitrate, methosulfate or acetate.

A particularly useful compound having the general formula listed above is one wherein $R_1$ and $R_2$ are alkyl groups having 1–3 carbon atoms, $R_3$ is an alkyl benzyl group such as a dodecylbenzyl, $R_4$ is polypropylene oxide group, and X is chloride.

Particularly useful quaternary ammonium compounds of the above-indicated general formula are the $C_{8-18}$ alkyl dimethyl ammonium chlorides and mixtures thereof.

Other particularly effective germicides that can be used in accordance with the present invention are a cationic germicide produced by Stepan Co. bearing the trademarks BTC 65 and BTC 2125 M. The BTC 65 composition, or ones like it, have a composition comprising about 50% n-alkyl (67% $C_{12}$, 25% $C_{14}$, 7% $C_{16}$, 1% $C_8+C_{10}+C_{18}$) dimethyl benzyl ammonium chlorides and 50% inert ingredients. The amount of $C_8$–$C_{18}$ alkyl groups in the composition can vary on both sides of the values listed. This composition will be effective when handled in a manner consistent with its labelling.

The BTC 2125 M composition comprises a similar compound. It is a blend of n-alkyl dimethyl benzyl ammonium chlorides wherein the active ingredients comprise 25% of a n-alkyl (60% $C_{14}$, 30% $C_{16}$, 5% $C_{12}$, 5% $C_{18}$) dimethyl benzyl ammonium chloride in admixture with 25% of a n-alkyl (68% $C_{12}$, 32% $C_{14}$) dimethyl ethylbenzyl ammonium chloride in admixture 50% with inert ingredients. The amounts of $C_{12}$ to $C_{18}$ groups can vary on both sides of the specific values listed herein. This composition also will be effective when handled in a manner consistent with its label.

The effective amount of cationic surfactant compound to be employed in accordance with the present invention ranges between about 0.20% and 60%, preferably between 40% and 60% of the treatment solution. The specific amounts of any particular cationic surfactant compound which may be employed within this range will depend on such factors relating to the intended end use of the article as can be readily determined by one of ordinary skill in the art.

The treating solution embodiments disclosed herein all require the presence of the glycol compounds specified hereinafter, which when moistened, exhibit nonionic surfactant properties. In addition, however, depending upon the specific end use to which the article of the present invention is to be put, the treating solution may also optionally contain up to 45% of a water-soluble nonionic surfactant in addition to the glycols specified herein.

Any of the well known classes of water-soluble nonionic surfactants may be employed in the invention.

Suitable nonionic surfactants include those selected from:

(a) the polyethylene oxide condensates of alkyl and dialkyl phenols, having a straight or branched alkyl group of from about 6 to about 12 carbon atoms, with ethylene oxide, wherein the amount of ethylene oxide present is from about 3 to about 25 moles per mole of alkyl phenol;

(b) the condensation products of aliphatic alcohols with ethylene oxide of the formula $RO(C_2H_4O)_nH$ and/or propylene oxide of the formula $RO(C_3H_6O)_nH$: wherein in either or both cases R is a straight or branched alkyl group having from about 8 to about 22 carbon atoms, and n is 3 to 40; and (c) polyoxyethylene polyoxypropylene block polymers.

Examples of nonionic surfactants of type (a) above are marketed by GAF Corporation under the trademark Igepal ®, e.g., Igepal ® CA-420, an octylphenol condensed with an average of 3 moles of ethylene oxide; or by Rohm and Haas under the trademark Triton ®, e.g., Triton ® X-100, an octylphenol condensed with an average of 9 moles of ethylene oxide.

Examples of nonionic surfactants of type (b) above are marketed by Shell Chemical Company under the trademark Neodol ®, e.g., Neodol ® 25-12, the condensation product of $C_{12-15}$ linear primary alcohol with an average of 12 moles of ethylene oxide, by Union Carbide Corporation under the trademark Tergitol ®, e.g., Tergitol ® 24L60, a polyethylene glycol ether of a mixture of synthetic $C_{12-14}$ fatty alcohols with an average of nine moles of ethylene oxide.

Examples of nonionic surfactants of type (c) above are marketed by BASF Wyandotte Corporation under the trademarks Pluronic ® and Plurafac ®, e.g., Pluronic ® 10 R5 which conforms to the formula $HO(CHCH_3CH)_x(CH_2CH_2O)_y\ (CHCH_3CH_2)_zH$ in which the average values of x, y and z are respectively 7, 22 and 7; and Plurafac ® B25-5, a linear straight chain primary alkoxylated alcohol.

When employed in accordance with the present invention, emulsifying effective amounts of nonionic surfactants are used; accordingly, the nonionic surfactants will be present up to about 45% of the treatment solution. The specific amount of the particular nonionic surfactant which is employed within this range will depend upon the detergent activity desired as can be readily determined by one of ordinary skill in the art; i.e., in applications requiring heavy duty cleaning power, higher amounts of nonionic surfactants in the treating solution would be used; and vice versa.

The dry article, optionally, but preferably may contain one or more fragrances for imparting a pleasant odor to the cleaned surface As used herein, the term "fragrance" includes chemicals which can mask malodors and/or destroy malodors. When employed, the fragrance is present in the dry wipe in amounts up to 5% of the treatment solution.

The glycol, used in accordance with the present invention, is preferably propylene glycol, USP.

Any glycol, such as the propylene glycol USP disclosed above, which is safe and nontoxic and possesses the ability to coat fibers uniformly may be used. The glycols used must impart softness to the dry nonwoven web and, when diluted with water, increase the cleaning efficiency of the dry wipe by means of the water.

The polyethylene glycols and CARBOWAX methoxy polyethylene glycols used in the present invention are a family of linear polymers formed by the addition reaction of ethylene oxide. The generalized formula for polyethylene glycol is:

$$HO—(CH_2CH_2O)_n—H$$

and for methoxy polyethylene glycol is:

$$CH_3O—(CH_2CH_2O)_n—H$$

where "n" is the average number of repeating oxyethylene groups. The repeating ether linkages and terminal hydroxyl groups give rise to the water solubility of the polyethylene glycols.

The CARBOWAX PEG 600 used herein consists of a distribution of polymers of varying molecular weights with an average of 600, which corresponds to an average number of repeating oxyethylene groups ("n") of 13.

Polyethylene glycols are generally available in average molecular weights ranging from 200 to 8000 and methoxy polyethylene glycols are available in average molecular weights ranging from 350 to 5000.

This wide range of polyethylene glycols provides flexibility in choosing properties to meet the requirements of many different applications.

An illustration of a method used in the formation of a matrix capable of being utilized in the present invention comprises combining cellulosic wood pulp fibers, and synthetic fibers, such as a linear polyester. Such a matrix is formed by mixing the aforementioned fibers in water to form a slurry containing 1% to 5% by weight of the fibers. This slurry is discharged through a metering slot onto a continuously moving fine wire screen (commonly referred to as a Fourdrinier screen). The moving screen is continuously shaken in a lateral fashion, normal to its direction of movement, causing the fibers thereon to become mechanically entangled, and also causing a large portion of the water to be drained therefrom with the result that a moist, cohesive. weblike matrix is formed at the end of said wire screen. The resultant moist, weblike matrix is then dried and wound into rolls suitable for subsequent treatment.

The method described above for preparing the matrix permits flexibility because the basis weight of the matrix is easily varied by way of controlling the slurry discharge metering device. Furthermore, the use of slurries makes it easy to incorporate a wide variety of fibers therein.

Another method for preparing the matrix is by laminating a plurality of web layers, comprised of specified natural and/or synthetic fibers of the same or varying basis weights, by any of the commercially or commonly practiced methods used in the trade, such as for example, through the use of adhesives, heat bonding, flame bonding, sonic bonding or mechanical or hydraulic entanglement. These methods permit the use of a variety of layers in constructing the matrix.

Commercially manufactured matrices. as for example, "Sontara," a registered trademark of E. I. DuPont consisting of a mixture of cellulosic and synthetic fibers, normally supplied in a basis weight of 62 grams per square yard, are also suitable for the cleaning wipe of this invention.

The matrix, prepared in accordance with one of the methods described above, from which the cleansing wipe or other products of the present invention are obtained, is coated and impregnated using a process wherein continuous rolls of said matrix are passed between an engraved roll and a smooth rubber roll under pressured nip contact. The engraved roll is constructed of steel or other suitable material whose surface has been engraved with a plurality of cells or cavities that are defined by specific shape and dimensions. Said shape and dimensions determine the volume of liquid picked up and held in the said cavities when in use.

During operation, the engraved roll is partially submerged in the cleaning solution described previously and rotates therethrough, causing said solution to fill the cavities of the engraved portions of said engraved roll. Excess solution accumulating above the plane of the engraving is removed by a doctor blade. The solution remaining in the cells of the engraved roll is caused to transfer by way of pressure absorption and surface tension into the matrix as it passes under pressure between said engraved roll and rubber roll.

Thereafter, the treated matrix, containing the measured volume of cleaning solution (which is capable of rendering the surface static free), may be wound onto rolls and/or is converted into the desired product. For the purposes of this specification, the term "conversion" means the process(es) of modifying the physical characteristics of the treated matrix by such known methods as crepeing, embossing, laminating, slitting, cutting, etc. so that the treated matrix is rendered into a form that is saleable as a manufactured product and is ready for distribution.

An important requirement of this method for treating said matrix with the cleaning (treatment) solution is that the lineal speed of the matrix passing through the nip formed by the engraved roll and rubber roll must equal the surface speed of the engraved roll. Furthermore, the rotation of the rolls must be in the same direction as the movement of the matrix.

Other methods of impregnating the matrix with measured amounts of (treatment) cleaning solution, such as by spraying, dipping, extrusion or by reverse roll, may also be used.

The coating/impregnation method described above enables a uniform and accurate application of all active ingredients to the woven or nonwoven matrix of natural and/or synthetic fibers or foam without the use of carriers and without the need for a separate step to dry the residual diluted solutions from the matrix.

Evaluation and testing of the wipe and other products of the present invention, as detailed in the examples included hereinafter, clearly establishes that the invention products differ from products found in the prior art in a number of ways. The formulation described and claimed herein consists of active ingredients only and no fillers, buffers or diluents are used. The particular active ingredients noted are dissolved in a nonaqueous component, thereby obviating the need for buffers, stabilizers and preservatives which are generally used in aqueous solutions for the purpose here described. The constituents comprising the solution present in the products of the instant invention are readily soluble in water when immersed therein.

An additional feature and benefit of the present invention resides in the use of a single treated matrix which is capable of being used in a variety of applications. As noted above, if one desires to dust and wash a hard surface, it is possible, using the article of the present invention, to dust the surface, then moisten the treated matrix with water, remove any surface film from the surface, followed by rinsing the treated matrix, removing the excess water and then using the treated matrix to dry the surface.

If one desires to remove dust from an air stream, it is possible, using the article of the present invention, to place the treated matrix in such a way as to force the dust laden air through the treated matrix causing the dust to contact and be held by the treated matrix. It is also possible by the addition of specific antimicrobials or disinfectants to the treating solution to disinfect any bacteria residing in or on the trapped dust removed from the dust laden air by contract with the treated matrix.

Furthermore, if one desires to destroy bacteria which contact the treated matrix other than through air borne dust, i.e. infectious or contaminated liquid spills as are often encountered in medical/hospital situations, it is possible, using the article of the present invention, to place the treated matrix in such a way as to capture and retain the contaminated liquid spill and then further actuate the disinfecting chemicals in the treated matrix such that the contaminated spill is rendered non-contaminating. Examples of this article would be a garment, drapes, mats, wipers, shoe covers, etc.

An additional feature and benefit characteristic is that the cleaning chemical and abrasive means, found separately in the prior art, as detailed above, are in this instance blended into a single article, i.e., the treated matrix. This treated matrix enables one to economically use specific surfactants, disinfectants and antistatic agents in combination, in the selected amounts desired, thereby surpassing any of the prior art products in either liquid or dry form. The following Examples are illustrative of the present invention.

EXAMPLE I

A matrix, comprising three sonically-bonded layers of a commercially available nonwoven web of polypropylene fibers wherein the polypropylene fibers in each layer are thermally bound together and possess a basis weight of 10 to 15 grams per square yard and was prepared so that the resultant bonded matrix had a basis weight of between 30 and 45 grams per square yard, was wound on a three inch core which was placed on an unwind stand and directed through an impregnating station consisting of an engraved printing roll having a pattern capable of applying the desired amount of treating solution to the matrix. The engraved roll was partially immersed in the treating solution such that, as the roll turned, it picked up treating solution from the pan containing same and transferred the solution to the nonwoven matrix. To assure proper transfer to the nonwoven matrix, a pressure roll was mounted above the engraved roll. The process described which was used above is commonly called a "printing" process.

The treating solution which was impregnated into the matrix comprised a mixture of the following constituents:

| | |
|---|---|
| Propylene glycol U.S.P. | 49% |
| A blend of a cationic surfactant including a propoxylated quaternary ammonium salt having the formula $R_1R_2R_3R_4N^+X^-$; where $R_1$ and $R_2$ are methyl, $R_3$ is dodecylbenzyl and $R_4$ is a polypropylene oxide group and X is chlorine; in admixture with an alkyl phenylethoxylate | |

-continued

| | | |
|---|---|---|
| nonionic surfactant | | 49% |
| Fragrance | | 2% |
| | TOTAL | 100% |

The nonwoven matrix was run through the printing process and picked up 3 to 4% of the treating solution, based on the basis weight of the matrix.

For the purpose of this example, after treatment, the roll of treated nonwoven matrix was run through a Hudson- Sharp automatic folding machine which yielded wipes which were quarter folded. The resultant wipes were capable of being used as dust cloths which upon immersion into water, activated the surfactants contained therein to become wet cleaning cloths.

An experimental test was run which compared the wipe prepared as set forth above with three commercially available dust cloths to determine dust removal ability, residue left after dusting and ability to clean in the presence of water.

The tests run to evaluate these characteristics were based upon visual observations, and reflected actual situations found in real life. The dust removal test was conducted on an 18"×18" black glass surface. An incident light source was positioned at 45° to the glass surface to observe the amount of dust collected and, subsequently, to observe the amount of residue left after dusting. The results are set forth in Table 1.

TABLE 1

| | Dust Removal | Residue Left |
|---|---|---|
| A. Present invention | yes | none |
| B. Silicone treated commercial cloth | yes | light smear |
| C. Lemon oil treated commercial cloth | yes | heavy smear |
| D. Stretchable, extensible treated commercial cloth | yes | heavy smear |

The data shown in Table 1 indicates that the commercially available products such as silicon and/or oils such as mineral and lemon oils act as a "glue" by catching and holding the dust on the surface. For these products to work, excessive quantities of the oils are added to the cloth. This is the cause of the residue seen on the glass plate. The residue acts as an adhesive for any airborn dust and, in essence, increases the amount of dust trapped on furniture surfaces.

The ability to remove oily dirt by cleaning with water is demonstrated in Table 2 below. The cationic surfactant of the present invention is immediately available to the water and reacts as any good cleaning compound—it dissolves and emulsifies the dirt and oil and, when squeezed dry, wipes up the excess water and the emulsified dirt in one wipe. The propylene glycol is also immediately dissolvable in water and increases the cleaning action of the cationic surfactants by reducing the surface tension of the water and allowing the cleansing solution to penetrate hard-to-reach areas.

The commercially available dust cloths cannot clean a surface because they are incompatible with water and leave an oil-in-water smear behind. Even when squeezed "dry," they are oily and only create more dirt to be cleaned.

The cloth corresponding to the cloth described above was used to dust a hard surface. Similarly, a cloth containing the same matrix described above was saturated with lemon oil instead of the solution of the present invention. The result showed a far superior result on the part of the cloth of the present invention insofar as the amount of dust picked up.

The ability of the wipe prepared above to clean in the presence of water was evaluated by immersing the wipe in water, squeezing it dry and then wiping it over soiled and smudged painted wood and metal surfaces which included door jambs and switch plates. The results in Table 2 set forth below showed that only the wipes of the present invention remove the dust and hand oils on the surfaces.

TABLE 2

| | Cleaning Ability |
|---|---|
| A. Present invention | acceptable |
| B. Silicone treated commercial cloth | none |
| C. Lemon oil treated commercial cloth | none |
| D. Stretchable extensible treated commercial cloth | none |

EXAMPLE II

This example demonstrates the use of the formulation of the present invention containing quaternary ammonium compounds as the cationic surfactants in the composition in contact with matrix.

A wiper similar to that in Example I was used in this experimental test except the matrix was composed of rayon fibers adhered to one another by a hydro-entangled process commonly used to mechanically entangle fibers by forcing water through the matrix at high pressure. A matrix of this type is commercially available from various nonwoven fabric manufacturers. The basis weight of this matrix is 80–90 grams per square yard.

The method of application is the same as described in Example I.

The impregnating solution in this case is as follows:

| | |
|---|---|
| Propylene Glycol U.S.P | 63% |
| Plurofac D-25 | 10% |
| Plurofac B-25-5 | 10% |
| Amine Oxide | 10% |
| The cationic surfactant of Example I | 5% |
| Fragrance | 2% |
| Total: | 100% |

This impregnating solution was added to the web at a level of 6–8% of basis weight of the web.

The tests detailed in Example I were conducted using the wipe prepared according to this Example II. The results were substantially identical to those obtained and set forth in Table 1 of Example I.

The uniqueness of this embodiment is that the dry dust cloth, when used, e.g., to remove dust from glass surfaces, such as television and computer screens, can be rinsed in water after use to remove the dust and, once wetted, becomes a heavier duty cleaning cloth than the cloth disclosed in Example I. An added characteristic is that the wet cloth disclosed in this Example II, when squeezed dry, will pick up and remove all moisture on a moisture-impervious surface leaving it dry and streak-free.

EXAMPLE III

A wiper was prepared which combined the synthetic polypropylene material disclosed in Example I above with a natural cellulose fiber.

The structure of the wiper comprised a cellulose towel stock having a basis weight of 5 to 10 grams per square yard between two polypropylene webs of the type and having the characteristics of the nonwoven polypropylene webs described in Example I. The layers were adhered by a sonic bonding technique. The resultant web weighed between 30 to 40 grams per square yard.

Using the impregnating formula and the method of application disclosed in Example I, the resulting wipes were tested for cleaning ability and substantially identical results were obtained a those shown in Table 1 of Example I.

EXAMPLE IV

A wiper was prepared comprising the rayon fibers described in Example II sandwiched between top and bottom layers of the commercially available nonwoven polypropylene webs described in Example I. The resultant web weighed between 30 to 40 grams per square yard. Using the same impregnating formula and method of application disclosed in Example I, a test surface was wiped with the cloth of Example III and compared with the results of the three other sample cloths disclosed in Table 1. The same results as found in Table 1 of Example I were obtained.

Examples I–IV clearly indicate that the makeup of the matrix is not critical to the success of the product, however, the specific combination of layers does allow for some specified uses which are dictated by the characteristics of the web.

EXAMPLE V

A matrix was formed by an "airlay" process which suspends cellulosic fibers and accumulates them in a stream of air and collects them on a screen.

The fibers were adhered by means of acrylic type binders which were sprayed on the total matrix and then dried. This type of matrix is generally commercially available.

The matrix used in this example weighed 81 grams per square yard.

The matrix, as described, was treated with the following solution in accordance with the printing process detailed in Example I.

The impregnating solution in this example consisted of:

| | |
|---|---|
| Propylene Glycol U.S.P. | 35.61% |
| Plurofac D-25 | 13.88% |
| Amine oxide | 3.88% |
| Cationic surfactant of Example I | 36.61% |
| Fragrance | 0.02% |
| Total: | 100.00% |

The impregnating solution was applied to the matrix at a level of 12–15% of the basis weight of the matrix.

A cleaning efficiency test was designed to mimic what a homemaker might encounter. The results of this test are found in column iii, Table 3, hereinafter.

The cleaning efficiency test was as follows. Two ml. of vegetable oil was applied to a glass plate with a pipette, and the oil was spread about the surface with a serrated edge strip; samples of ketchup, mustard and a mayonnaise mixture (1:1:1) were applied to surfaces other than glass, using a plastic template. In each instance, the sample material was allowed to stand for 30 minutes. Then, using a moistened test wiper and the standard wetting technique, the surface was wiped with the moistened wiper. The number of wiping motions needed to clean the surface was recorded along with visual observations of residue remaining on the surface. The test was repeated five times.

The control found in column i, Table 3, used a HandiWipe ® and Joy ® liquid detergent (the Joy ® was diluted with water as per instruction) to demonstrate the efficiency in removing normal kitchen debris from various surfaces. The control required additional wiping after food debris was removed to remove all the excess suds left on the surface. The sample of the present invention removed both debris and foam at all times.

EXAMPLE VI

Having shown in previous examples that substantially dry wipers can act as dust cloths and, when wetted, act as detergent cleaning cloths suitable for spot cleaning or kitchen cleaning, the following examples show a unique product which can also demonstrate a disinfectant properties along with the detergent properties which it possesses.

Three separate matrices were used in this example. Three matrices comprised the materials cited in the following categories: (A) Example II (rayon, hydroentangled basis weight of 90 grams per square yard); (B) another product identical in composition to Example V, but having a basis weight of 35–40 grams per square yard; and (C) Example V (cellulosic, airlay, basis weight 80 grams per square yard).

They were treated using the "printing process" as previously described with an impregnating solution consisting of the following:

| | |
|---|---|
| Propylene Glycol U.S.P. | 52.25% |
| Quaternary Ammonium (BTC 2125M by Stepan) | 12.50% |
| Plurofac D-25 | 10.00% |
| Plurofac B-25-5 | 10.00% |
| Amine oxide | 10.00% |
| Cationic surfactant of Example I | 5.00% |
| Fragrance | 0.25% |
| Total: | 100.00% |

The above impregnating solution was added to each of the three webs at 10–12% of the basis weight of the web.

A cleaning efficiency test was run on the matrix identified in category (C) above (the matrix of Example V). The results are reported in column ii, Table 3. The cleaning efficiency was somewhat better for the detergent/disinfectant than in detergent alone.

TABLE 3

COMPARATIVE CLEANING EFFICIENCY OF EXAMPLE V MATRIX CONTAINING DIFFERENT SOLUTIONS

Number of Wipings Required to Clean and Dry

| Surface | (i) Control KMM (oil) | (ii) Detergent/ Disinfectant Airlay Nonwoven KMM (oil) | (iii) Detergent Airlay Nonwoven KMM (oil) |
|---|---|---|---|
| Ceramic Tile (Textured) | 2.2 (2.2) | 3.2 (4.0) | 5.8 (5.0) |
| Ceramic Tile (Smooth) | 2.4 (2.2) | 2.8 (3.4) | 3.4 (6.6) |
| Formica | 2.8 (3.0) | 3.8 (4.6) | 3.6 (4.6) |
| Linoleum | 3.0 (2.8) | 4.0 (3.4) | 4.4 (4.2) |
| Average | 2.6 (2.6) | 3.5 (3.9) | 3.8 (5.1) |
| Dry | +2.0 (+2.0) | +0 (+0) | +0 (+0) |

Control: HandiWipe ® and Joy ® dishwashing liquid in water.
(oil) = oil
KMM = ketchup, mustard, mayonnaise

EXAMPLE VII

To verify that an antimicrobial agent such as BTC 2125M by Stepan Chemical having the composition detailed above would in fact be active, a test for the antimicrobial activity was performed on treated matrices identified as categories A, B and C in Example VI above and were at least 30 days old. The results are listed in Table 4.

The test results set forth in Table 4 above were designed to show the effectiveness of anti-microbials or bacteriastats by placing these products in the center of a dish containing actively growing bacteria.

The products, once moistened and placed in the center of this actively growing bacterial colony, are left in contact for a period of time.

If the product placed there has no anti-microbial activity, the bacteria will grow over it and this is reported as "0" or none in the test report. This is the response listed next to the untreated substrates.

If the product has anti-microbial activity, the bacteria die and do not overgrow this area. The greater the anti-microbial activity, the larger the "dead" zone is. This is referred to as the zone of inhibition. This response is listed under treating solutions and usually shows the highest zones.

When the treating solution is added to the webs or matrices, the activity of the anti-microbials is reduced because the active chemical tends to attack the fibers and is then unable to attack the bacteria.

The responses listed under treated wipes show very close activity to the treating solution as seen in the size of the zones of inhibition. This is unusual and indicates that the anti-microbial chemicals were prevented from attacking the fibers and were essentially held in a "ready" state for use against the bacteria.

The results listed in Table 4 show that the dry untreated wipers show no antimicrobial effects; that the actual impregnating solution does show antimicrobial activity; and that the treated wipers show effects almost identical to the pure impregnating solution. These results support the conclusion that this product is unique and that the activity of an antimicrobial agent such as BTC 2125M is not greatly reduced during contact with a cellulosic web. The results are unexpected because the state of the prior art teaches that in like situations, there are generally losses of about 50% of the formulated amount of active disinfecting agent as a result of interaction of the agent with the cellulosic fibers.

To confirm this, chemical analyses of the levels of BTC 2125M were performed and found that 0.60% of the formulated 0.625% was recoverable.

TABLE 4

ZONE OF INHIBITION REPORT OF EVALUATION OF NON-WOVEN FABRIC TREATED WITH CATIONIC (ANTIMICROBIAL) AGENTS WITH ADDED WATER TO ACTIVATE CATIONIC AGENTS

| Sample Description | Untreated Fab "A" | Untreated Fab "B" | Untreated Fab "C" | Liquid Form "B" | Form. "B" Fab "A" | Form. "B" Fab "B" | Form. "B" Fab "C" |
|---|---|---|---|---|---|---|---|
| *Staphylococcus aureus* | None | None | None | 15 mm. | 12 mm. | 11 mm. | 15 mm. |
| *Escherichia coli* | None | None | None | 10 mm. | 10 mm. | 10 mm. | 10 mm. |
| *Pseudomonas cepacia* | None | None | None | 13 mm. | 8 mm. | 10 mm. | 12 mm. |
| *Salmonella typhimurium* | None | None | None | 11 mm. | 10 mm. | 10 mm. | 10 mm. |
| *Candida albicans* | None | None | None | 8 mm. | 8 mm. | 8 mm. | 8 mm. |
| *Penicullium & Aspergillus* | None | None | None | 8 mm. | 8 mm. | 8 mm. | 8 mm. |

Note:
NONE: No ability to inhibit growth of bacteria
mm.: An ability to inhibit growth of bacteria
Fabric "A": Rayon fiber, Hydro-entangled, basis weight: 90 gr./square yard
Fabric "B": Cellulosic Fiber, Airlay, basis weight: 30–40 gr./square yard
Fabric "C": Cellulosic Fiber, Airlay, basis weight: 80 gr./square yard

EXAMPLE VIII

Further tests were performed to establish the level of potential toxicity of this detergent (Example V matrix) and detergent/disinfectant (Example V, category C matrix) products. Both tests were conducted on the matrix described in category "C" of Example VI (i.e., cellulosic, airlay, 80 gram/square yard).

The results, listed in Table 5, show that unexpectedly, the present invention provides a non-toxic wiper.

TABLE 5

SUMMARY OF PRODUCT SAFETY RESULTS

| Product | Test | Results |
|---|---|---|
| Detergent/Disinfectant Wipe (Ex. VI, Matrix C) | Acute Oral Toxicity, rats, FHSA | Category IV, no deaths |
| Detergent/Disinfectant Wipe (Ex. VI, Matrix C) | Eye Irritation, rabbits, EPA | Category III, slight conjunctional irritation |
| Detergent/Disinfectant Wipe (Ex. VI, Matrix C) | Primary Dermal Irritation rabbits, EPA | Category IV, Primary Irritation Index 0 at 48 hours, 0.83 at 5 hours, 0.33 at 24 hours |
| Detergent Wipe (Ex. V) | Acute Oral Toxicity, rats, FHSA | Not toxi, LD 50 5 g./Kg. |
| Detergent Wipe (Ex. V) | Eye Irritation, rabbits, EPA | Non-irritant (all 0) |
| Detergent Wipe (Ex. V) | Primary Dermal Irritation rabbits, FHSA | Non-irritant, Primary Irritation Index 0 |
| Detergent/Disinfectant Wipe (Ex. VI, Matrix C) | Acute Oral Toxicity, rats, FHSA | Not toxic LD 50 5 g./Kg. |
| Detergent/Disinfectant Wipe (Ex. VI, Matrix C) | Eye irritation, rabbits EPA | Indeterminate (Test 1); Non-irritant (Test 2) |
| Detergent/Disinfectant Wipe (Ex. VI, Matrix C) | Primary Dermal Irritation rabbits, FHSA | Non-irritant, Primary Irritation Index 0.25 |

The "Results" column found in Table 5 above cites toxicity categories set by the E.P.A. Toxicity Category chart, an excerpt of which is set forth in Table 6 below, as stated in 40 C.F.R. 162.10(h) (1) and by tests established by the Federal Hazardous Substances Act (FHSA).

TABLE 6

EPA TOXICITY CATEGORY CHART

Categories are assigned on the basis of the highest hazard shown by any of the indicators in the Table below:

| HAZARDOUS INDICATORS | TOXICITY CATEGORIES | | |
|---|---|---|---|
| I | II | III | IV |
| Oral $LD_{50}$ . . . Up to and including 50 mg/kg | From 50 thru 500 mg/kg | From 500 through 5000 mg/kg | Greater than 5000 mg/kg |
| Inhalation $LC_{50}$ . . . Up to and including 0.2 mg/liter | From 0.2 thru 2 mg/liter | From 2 thru 20 mg/liter | Greater than 20 mg/liter |
| Dermal $LD_{50}$ . . . Up to and including 200 mg/kg | From 200 thru 2000 mg/kg | From 2000 thru 20,000 | Greater than 20,000 |
| Eye Effects . . . Corrosive; corneal opacity not reversible within 7 days | Corneal opacity reversible within 7 days; irritation persisting for 7 days | No corneal opacity; irritation reversible within 7 days | No irritation |
| Skin Effects . . . Corrosive | Severe irritation at 72 hours | Moderate irritation at 72 hours | Mild or slight irritation at 72 hours |

EXAMPLE IX

A matrix consisting of thermally bonded polypropylene fibers, having a basis weight of 10–45 grams per square yard, was wound on a three inch core which was placed on an unwind stand and directed through an impregnating station consisting of an engraved printing roll having a pattern capable of applying the desired amount of treating solution to the matrix. The engraved roll partially immersed in the treating solution such that, as the roll turned, it picked up treating solution from the pan containing same and transferred the solution to the nonwoven matrix. To assure proper transfer to the nonwoven matrix, a pressure roll was mounted above the engraved roll. The process described which was used above is commonly called a "printing" process.

The above described matrix before treatment is one commonly used in air filters for office and room air filtration.

This matrix treated using the "printing" process as previously described with a treating solution consisting of the following:

| Formula "B" | |
|---|---|
| Propylene Glycol U.S.P. | 52.25% |
| Quaternary Ammonium (BTC 2125M by Stepan) | 12.50% |
| Plurofac D-25 | 10.00% |
| Plurofac B-25-5 | 10.00% |
| Amine oxide | 10.00% |
| Cationic surfactant of Example I | 5.00% |
| Fragrance | 0.25% |
| Total: | 100.00% |

The above treating solution was added to the matrix at 8–10% of the basis weight of the web.

The test of the antimicrobial characteristics of this air filter matrix was performed using a "zone of inhibition".

The test results set forth in Table 7 following, were designed to show the effectiveness of antimicrobials or bacteriastats by placing these products in the center of a dish containing actively growing bacteria.

The treated fabric, once cut in circles and placed in the center of these actively growing bacterial colonies, is left in contact with these bacterial colonies for a period of time.

If the product placed there has no antimicrobial activity, the bacteria will grow over it and this is reported "0" or none in the test report.

If the product has antimicrobial activity, the bacteria die and do not overgrow this area. The greater the antimicrobial activity, the larger the "dead" zone is. This is referred to as the "zone of inhibition".

The lab results show that some antimicrobial activity is evident against Staphyloccus Aureus (ATTCC 6538) and Pseudomonas Aeruginosa (ATCC 9027).

It is important to note that the benefit here shown is that the treated air filter will not allow bacterial growth after exposure to actively growing bacterial colonies. This "zone of inhibition" test did not include any added water to activate the antimicrobial chemicals thus showing antimicrobial characteristics while dry, thus showing its effectiveness at ambient temperature and humidity.

TABLE 7

ZONE OF INHIBITION REPORT OF EVALUATION OF AIR FILTER MATERIAL TREATED WITH A NON AQUEOUS SOLUTION OF CATIONIC (ANTIMICROBIAL) AGENTS

| | ZONE OF INHIBITION/MM | |
|---|---|---|
| | *Staphyloccus aureus* | *Pseudomonas aeruginosa* |
| Untreated Air Filter | 0 | 0 |
| Treated Air Filter-Edge | 6.4 | 9.7 |
| Treated Air Filter-Middle | 9.6 | 9.1 |

INTERPRETATION 7 mm circles were aseptically cut from the samples and placed on tryptic soy agar plates seeded with Staphylococcus aureus ATC 6538 and Pseudomonas aeruginosa ATC 9027. Samples from middle and edge of the air filter material were tested against each organism. No water was added to the test samples. Four samples were tested against each organism. After incubation, the zones of inhibition were measured. These zones show inhibition of growth in both treated samples.

EXAMPLE X

A matrix consisting of thermally bonded polyester fibers and cellulosic fibers, having a basis weight of 30–90 grams (specifically 60 grams) per square yard, and having been mechanically bonded by a process called "hydroentangling" (i.e. using jets of water to intermingle the fibers) and optionally having been treated by the manufacturer to render the matrix water resistant (i.e. resistant to penetration of bodily fluids such as urine or blood), was wound on a three inch core which was placed on an unwind stand and directed through an impregnating station consisting of an engraved printing roll having a pattern capable of applying the desired amount of treating solution to the matrix. The engraved roll partially immersed in the treating solution such that, as the roll turned, it picked up treating solution from the pan containing same and transferred the solution to the nonwoven matrix. To assure proper transfer to the nonwoven matrix, a pressure roll was mounted above the engraved roll. The process described which was used above is commonly called a "printing" process.

The above matrix is one commonly used in garments and drapes for hospital environments.

This matrix was treated using the "printing" process as previously described with a treating solution consisting of the following:

| Formula "B" | |
|---|---|
| Propylene Glycol U.S.P. | 52.25% |
| Quaternary Ammonium (BTC 2125M by Stepan) | 12.50% |
| Plurofac D-25 | 10.00% |
| Plurofac B-25-5 | 10.00% |
| Amine oxide | 10.00% |
| Cationic surfactant of Example I | 5.00% |
| Fragrance | 0.25% |
| Total: | 100.00% |

The above treating solution was added to the matrix at 5–7% of the basis weight of the web.

A test of the antimicrobial characteristics of this garment matrix was performed using a "zone of inhibition".

The test results set forth in Table 8 following, were designed to show the effectiveness of antimicrobials or bacteriastats by placing these products in the center of a dish containing actively growing bacteria.

The treated fabric, once cut in circles and placed in the center of these actively growing bacterial colonies, is left in contact with these bacterial colonies for a period of time.

If the product placed there has no antimicrobial activity, the bacteria will grow over it an this is reported "0" or none in the test report.

If the product has antimicrobial activity, the bacteria die and do not overgrow this area. The greater the antimicrobial activity, the larger the "dead" zone is. This is referred to as the "zone of inhibition".

The lab results show that some antimicrobial activity is evident against Staphyloccus Aureus (ATCC 6538) and Pseudomonas Aeruginosa (ATCC 9027).

It is important to note that the benefit here shown is that the treated garment will not allow bacterial growth after exposure to activity growing bacterial colonies. This "zone of inhibition" test did not include any added water to activate the antimicrobial chemicals thus showing antimicrobial characteristics while dry.

Table 8 indicates the effectiveness of the treated matrix when antimicrobial chemicals are added to the treating solution which is printed onto a matrix and left in a "dry" condition.

In Example VII, Table 4 shows the increase in antimicrobial characteristic when the treated matrix is contacted with water.

Since the treating solution in these examples is the same, the reasonable expectation is for the above treated matrix to exhibit increased efficacy when contacted with water or aqueous spills.

TABLE 8

| ZONE OF INHIBITION REPORT OF EVALUATION OF GARMENT MATERIAL TREATED WITH A NON AQUEOUS SOLUTION OF CATIONIC (ANTIMICROBIAL) AGENTS | ZONE OF INHIBITION/MM | |
|---|---|---|
| | *Staphylococcus aureus* | *Pseudomonas aeruginosa* |
| Untreated Garment | 0 | 0 |
| Treated Garment-Edge | 8.7 | 7.5 |
| Treated Garment-Middle | 10.9 | 7.3 |

INTERPRETATION:

7 mm circles were aseptically cut from the samples and placed on tryptic soy agar plates seeded with Stahylococcus aureus ATC 6538 and Pseudomonas aeruginosa ATC 9027. Samples from middle and edge of the garment material were tested against organism. No water was added to the test samples. Four samples were tested against each organism. After incubation, the zones of inhibition were measured. These zones show inhibition of growth in both treated samples.

EXAMPLE XI

A matrix consisting of thermally bonded polyester fibers and cellulosic fibers, having a basis weight of 30-90 grams (specifically 60 grams) per square yard, and having been mechanically bonded by a process called "hydroentangling" (i.e. using jets of water to intermingle the fibers) and optionally having been treated by the manufacturer to render the matrix water resistant (i.e. resistant to penetration of bodily fluids such as urine or blood), was wound on a three inch core which was placed on an unwind stand and directed through an impregnating station consisting of an engraved printing roll having a pattern capable of applying the desired amount of treating solution to the matrix. The engraved roll partially immersed in the treating solution such that, as the roll turned, it picked up treating solution from the pan containing same and transferred the solution to the nonwoven matrix. To assure proper transfer to the nonwoven matrix, a pressure roll was mounted above the engraved roll. The process described which was used above is commonly called a "printing" process To assure total resistance to liquid penetration, a thermoplastic film of 0.6-3.0 mils thickness can be adhered to the matrix by any known method, specifically heat/pressure or sonic.

The above matrix is one commonly used in absorbing liquid spills.

This matrix (before the addition of the thermoplastic film) was treated using the "printing" process as previously described with a treating solution consisting of the following:

| Formula "B" | |
|---|---|
| Propylene Glycol U.S.P. | 52.25% |
| Quaternary Ammonium (BTC 2125M by Stepan) | 12.50% |
| Plurofac D-25 | 10.00% |
| Plurofac B-25-5 | 10.00% |
| Amine oxide | 10.00% |
| Cationic surfactant of Example I | 5.00% |
| Fragrance | 0.25% |

-continued

| Formula "B" | |
|---|---|
| Total: | 100.00% |

The above treating solution was added to the matrix at 5-7% of the basis weight of the web.

A test of the antimicrobial characteristics of this matrix was performed using a "zone of inhibition".

The test results set forth in Table 8 above, show the effectiveness of antimicrobials or bacteriastats by placing these products in the center of a dish containing actively growing bacteria.

The treated matrix, once cut in circles and placed in the center of these actively growing bacterial colonies, is left in contact with these bacterial colonies for a period of time.

If the product placed there has no antimicrobial activity, the bacteria will grow over it and this is reported "0" or none in the test report.

If the product has antimicrobial activity, the bacteria die and do not overgrow this area. The greater the antimicrobial activity, the larger the "dead" zone is. This is referred to as the "zone of inhibition".

The lab results show that some antimicrobial activity is evident against Staphyloccus Aureus (ATCC 6538) and Pseudomonas Aeruginosa (ATCC 9027).

It is important to note that the benefit here shown is that the treatment mat will not allow bacterial growth after exposure to actively growing colonies. This "zone of inhibition" test did not include any added water to activate the antimicrobial chemicals thus showing antimicrobial characteristics while dry.

Table 8 indicates the effectiveness of the treated matrix when antimicrobial chemicals are added to the treating solution which is printed onto a matrix and left in a "dry" condition.

Table 4 (Example VII) shows the increase in antimicrobial characteristic when the treated matrix is contacted with water.

Since the treating solution in these examples is the same, the reasonable expectation is for the above treated matrix to exhibit increased efficiency when contacted with water or aqueous spills.

EXAMPLE XII

This example describes a treated hand towel. As previously demonstrated, a substantially dry flexible wiper when treated with a non aqueous solution containing proplyene glycol, non-ionic surfactants and cationic surfactants including the quaternary ammonium compounds, can be converted and then wetted with water and used to clean & disinfect hard surfaces.

Using the same non aqueous treatment system as stated above in conjunction with the matrices cited, the resultant dry wipe can be activated to clean and degerm skin when water is present.

The significance here is that the controlled amount of cleaning and sanitizing/disinfectant chemical as previously shown in hard surface cleaning can be used in skin cleaning.

The skin cleaning procedure provides for the use of the water added to the skin e.g. hands, to be used to activate the cleaning and sanitizing/disinfectant (or degerming) treatment on the wipe. Once activated, the wipe will clean and degerm the skin surface as well as it does a hard surface.

The wetted wiper will remove the surface debris and in so doing degerm the body or hands.

A matrix in this example was formed by a "wet-lay" process which suspends cellulosic fibers and accumulates them in a stream of water and collects them on a screen. Matrix was then dried and wound into a roll.

The fibers may be adhered by means of binders which are sprayed on the total matrix and then dried. This type of matrix is generally commercially available as a hand towel.

The matrix used in this example weighed 35–40 grams per square yard.

Using a similar product weighing approximately. 35–40 grams per square yard and adhered by a high wet strength adhesive the following composition was applied:

| | |
|---|---|
| Propylene Glycol U.S.P | 51% |
| Quaternary Ammonium (n alkyl dimethyl benzyl ammonium chloride) | 8% |
| Cationic Surfactant | 40% |
| Fragrance | 1% |
| Total: | 100% |

The matrix described above before treatment is one commonly used in drying hands. The composition applied was added at 8–10% of the basis weight of the matrix. The treatment was added using the printing process previously described.

As can be seen from the previous examples, the combination of matrix and treatment solution containing antimicrobial cationic agents yields a product which, when exposed to water, kills baterial contamination, even when dry (see Table 9).

As one can tell from the previous examples, and as highlighted in Table 4, these dry antimicrobial wipes increase their efficacy when water is added.

It is, therefore, a reasonable conclusion to use the treated hand towel of this example in conjunction with water-wetted hands or other skin areas to clean and degerm those skin areas.

TABLE 9

ZONE OF INHIBITION REPORT OF EVALUATION OF TOWEL MATERIAL TREATED WITH A NON-AQUEOUS SOLUTION OF CATIONIC (ANTIMICROBIAL) AGENTS NO WATER ADDED

| | ZONE OF INHIBITION/MM *Staphylococcus aureus* |
|---|---|
| Untreated Towel Material | 0 |
| Treated Towel Material-Edge | 10.0 |
| Treated Towel & Lotion Material-Middle | 7.7 |

INTERPRETATION:

5 mm circles were aseptically cut from the samples and placed on tryptic soy agar plates seeded with Staphtlococcus aureus ATC 6538 no water was added to the test samples. Four samples were tested against the organism. After incubation, the zones of inhibition were measured. These zones show inhibition of growth.

EXAMPLE XIII

As previously demonstrated, a substantially dry flexible wiper when treated with a non aqueous solution containing Propylene Glycol, non ionic surfactants and cationic surfactants including the quaternary ammonium compounds—can be converted and then wetted with water and used to clean & disinfect hard surfaces Using the same non aqueous treatment system including a lotionizing product such as polyethylene glycol, in conjunction with the matrices cited, the resultant dry wiper can be activated to clean, degerm and lotionize the skin when water is present on the skin.

The significance here is that the controlled levels of cleaning, degerming and lotionizing chemicals as previously shown in hard surface cleaning can be used in skin cleaning.

Skin cleaning allows the use of the water added to skin to be used to activate the cleaning degerming and lotionizing treatment on the wiper. Once activated, the wiper will clean and degerm the skin surface. The wetted wiper will remove the surface debris and in so doing degerm the skin.

Finally, the wetted wiper will leave the lotionizing component on the skin thereby imparting a soft feel to the skin.

A matrix was formed by a "wet-lay" process which suspends cellulosic fibers and accumulates them in a stream of water and collects them on a screen. Matrix is then dried and wound into a roll.

The fibers may be adhered by means of binders which are sprayed on the total matrix and then dried. This type of matrix is generally commercially available as a hand towel.

The matrix used in this example weighed 35–40 grams per square yard.

Using a similar product weighing approximately 35–40 grams per square yard and adhered by a high wet strength adhesive we added the following composition:

| | |
|---|---|
| Propylene Glycol U.S.P. | 62.00% |
| Quaternary Ammonium (N Alkyl Dimethyl Benzly Ammonium Chloride) | 8.00% |
| Plurofac D-25 | 10.00% |
| Plurofac B-25-5 | 10.00% |
| Polyethylene Glycol | 9.50% |
| Fragrance | .50% |
| Total: | 100.00% |

The untreated matrix prepared in this example is one commonly used in drying hands. The composition treatment was added at 8–10% of the basis weight of the matrix. The composition was added using the printing process previously described.

As can be seen from the previous examples, the combination of matrix and treatment solution containing antimicrobial cationic agents yields a product which kills bacterial contamination, even when dry (see Table 9).

As one can tell from the previous examples, and as highlighted in Table 4, these dry antimicrobial wipes increase their efficacy when water is added.

It is, therefore, a reasonable conclusion to use the treated hand towel of this example in conjunction with water-wetted hands or other skin areas to clean and degerm those skin areas.

What we claim and desire to protect by Letters Patent is:

1. A method of making a substantially flexible dry matrix processing antimicrobial properties to which no water has been added other than that naturally present therein, which comprises: passing a continuous line of a matrix material comprising (a) natural or synthetic, woven, non-woven or knitted fibers, or (b) flexible foam material or combinations thereof between an engraved roll and smooth roll, said engraved roll containing a non-aqueous treatment solution on the surface thereof, coating said matrix material with an antimicrobial effective amount of, or a disinfecting effective amount of said non-aqueous treatment solution from said engraved roll, the amounts of the respective said coatings also being sufficient to allow said matrix to retain its substantially flexible dry characteristics, said non-aqueous treatment solution comprising between about 25% and 75% by weight of a cationic surfactant having antimicrobial or disinfecting properties; and thereafter converting said matrix by forming same into a shaped article of commerce.

2. The method defined in claim 1 wherein an antimicrobial garment is formed as a result of said converting step.

3. The method defined in claim 1 wherein an antimicrobial air filter is formed as a result of said converting step.

4. The method defined in claim 1 wherein an antimicrobial mat is formed as a result of said converting step.

5. The method defined in claim 1 wherein a hand towel is formed as a result of said conversion step.

6. The method defined in claim 1, wherein said matrix is coated with between about 1% and 99% of said treatment solution calculated on the basis weight of said matrix.

7. The method defined in claim 6 wherein said matrix is coated with between about 3% and 25% of said treatment solution calculated on the basis weight of said matrix.

8. The method defined in claim 7 wherein said treatment solution contains effective amounts of at least one fragrance.

9. The method defined in claim 1 wherein said treatment solution contains between about 0.1% and 5% fragrance.

10. The method defined in claim 7 wherein said matrix comprises a polyolefin.

11. The method defined in claim 7 wherein said matrix comprises a polyester.

12. The method defined in claim 7 wherein said matrix comprises nylon.

13. The method defined in claim 7 wherein said matrix comprises a cellulosic.

14. The method defined in claim 7 wherein said matrix comprises a cotton.

15. The method defined in claim 7 wherein said matrix comprises rayon.

16. The method defined in claim 7 wherein said matrix comprises hemp.

17. The method defined in claim 7 wherein said matrix comprises a polyester foam.

18. The method defined in claim 7 wherein said matrix comprises a polyurethane foam.

19. The method defined in claim 7 wherein said matrix comprises polypropylene fibers coated with between about 3% and 12% of said treatment solution which comprises approximately 40 to 60% propylene glycol and, correspondingly, approximately 40 to 60% of said cationic surfactant with the balance being antimicrobial compound.

20. The method defined in claim 7 wherein said matrix comprises polypropylene and rayon fibers coated with between about 3% and 12% of said treatment solution comprising approximately 40% to 60% propylene glycol and correspondingly approximately 40% to 60% of said cationic surfactant, with the balance being antimicrobial compound.

21. The method defined in claim 7 wherein said matrix is polypropylene, and said treatment solution comprises about 49% propylene glycol and about 49% of a cationic surfactant, with the balance being antimicrobial compound.

22. The method defined in claim 7 wherein said cationic surfactant compound is selected from the group consisting of water soluble quaternary ammonium compounds and polymeric quaternary ammonium compounds of the general formula:

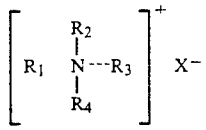

wherein $R_1$ and $R_2$ are selected from an alkyl group, an alkyl ether group and a hydroxyalkyl group each containing from 1 to 3 carbon atoms, $R_3$ is an alkyl group containing from 6 to 20 carbon atoms, and $R_4$ is selected from an alkyl group containing 6 to 20 carbon atoms, an aralkyl group wherein alkyl contains 1 to 2 carbon atoms and heterocyclic radicals, and $X^-$ is a suitable anion selected from the group consisting of halide, chloride, bromide, iodide, nitrate, methosulfate or acetate.

23. The method defined in claim 22 wherein said matrix is selected from the group consisting of polypropylene, polyester, nylon, cotton, hemp, rayon fibers and polyurethane foam, polyether foam and polyester foam.

24. The method defined in claim 23 wherein said quaternary ammonium compound has the general formula $C_{8-18}$, alkyl dimethyl ammonium chlorides and mixtures thereof.

25. The method defined in claim 23 wherein the matrix is polypropylene and said treatment solution comprises between about 40% and 60% of a quaternary ammonium compound having the general formula:

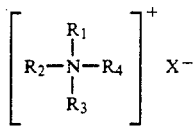

wherein $R_1$ and $R_2$ are alkyl groups having 1-3 carbon atoms; $R_3$ is an alkyl benzyl group where the alkyl group has 6-22 carbon atoms; $R_4$ is polypropylene oxide group.

26. The method defined in claim 22 wherein the matrix is rayon and said treatment solution comprises between about 40% and 60% of a quaternary ammonium compound having the general formula:

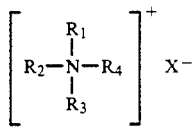

wherein $R_1$ and $R_2$ are alkyl groups having 1-3 carbon atoms; $R_3$ is an alkyl benzyl group where the alkyl group has 6–22 carbon atoms; $R_4$ is a polypropylene oxide group.

27. The method defined in claim 23 wherein the matrix is cellulosic and said treatment solution comprises between about 40% and 60% of a quaternary ammonium compound having the general formula:

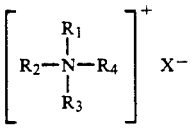

wherein $R_1$ and $R_2$ are alkyl groups having 1–3 carbon atoms; $R_3$ is an alkyl benzyl group wherein the alkyl group has 6–22 carbon atoms; $R_4$ is a polypropylene oxide group.

28. The method defined in claim 23 wherein the matrix is comprised of a layer of cellulose fibers sandwiched between layers of polypropylene fibers and said treatment solution comprises between about 40% and 60% of a quaternary ammonium compound having the general formula:

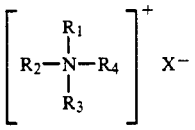

wherein $R_1$ and $R_2$ are alkyl groups having 1–3 carbon atoms; $R_3$ is an alkyl benzyl group where the alkyl group has 6–22 carbon atoms; $R_4$ is polypropylene oxide.

29. The method defined in claim 1 wherein said treatment solution contains up to 45% of a nonionic surfactant selected from the group consisting of:

(a) the polyethylene oxide condensates of alkyl and dialkyl phenols, having a straight or branched alkyl group of from about 6 to about 12 carbon atoms, with ethylene oxide, wherein the amount of ethylene oxide present is from about 3 to about 25 moles per mole of alkyl phenol;

(b) the condensation products of aliphatic alcohols with ethylene oxide of the formula $RO(C_2H_4O)_nH$ and/or propylene oxide of the formula $RO(C_3H_6O)_nH$: wherein in either or both cases R is a straight or branched alkyl group having from about 8 to about 22 carbon atoms, and n is 3 to 40; and (c) polyoxyethylene-polyoxypropylene block copolymers.

30. The method defined in claim 29, wherein said matrix is coated with between about 1% and 99% of said treatment solution calculated on the basis weight of said matrix.

31. The method defined in claim 29 wherein said matrix is coated with between about 3% and 25% of said treatment solution calculated on the basis weight of said matrix.

32. The method defined in claim 31 which contains effective amounts of at least one fragrance.

33. The method defined in claim 31 wherein said treatment solution contains between about 0.1% and 5% fragrance.

34. The method defined in claim 31 wherein said matrix comprises a polyolefin.

35. The method defined in claim 31 wherein said matrix comprises a polyester.

36. The method defined in claim 31 wherein said matrix comprises nylon.

37. The method defined in claim 31 wherein said matrix comprises a cellulosic.

38. The method defined in claim 31 wherein said matrix comprises a cotton.

39. The method defined in claim 31 wherein said matrix comprises rayon.

40. The method defined in claim 31 wherein said matrix comprises hemp.

41. The method defined in claim 31 wherein said matrix comprises polyester foam.

42. The method defined in claim 31 wherein said matrix comprises a polyurethane foam.

43. The method defined in claim 31 wherein said matrix comprises polypropylene fibers coated with between about 3% and 12% of said treatment solution which comprises between 25% and 60% propylene glycol, approximately 5% to 25% of said cationic surfactant, up to 45% nonionic surfactant, and the balance being said antimicrobial compound.

44. The method defined in claim 31 wherein said matrix comprises polypropylene and rayon fibers coated with between about 3% and 12% of said treatment solution comprising between 25% and 60% propylene glycol, approximately 5% to 25% of said cationic surfactant, and up to 45% of a nonionic surfactant and the balance being said antimicrobial compound.

45. The method defined in claim 31 wherein said cationic surfactant compound is selected from the group consisting of water soluble quaternary ammonium compounds and polymeric quaternary ammonium compounds of the general formula:

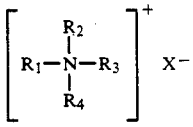

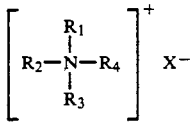

wherein $R_1$ and $R_2$ are selected from an alkyl group, an alkyl ether group and a hydroxyalkyl group each containing from 1 to 3 carbon atoms, $R_3$ is an alkyl group containing from 6 to 20 carbon atoms, and $R_4$ is selected from an alkyl group containing 6 to 20 carbon atoms, an aralkyl group wherein alkyl contains 1 to 2 carbon atoms and heterocyclic radicals, and $X^-$ is a suitable anion halide, selected from the group consisting of chloride, bromide, iodide, nitrate, methosulfate or acetate.

46. The method defined in claim 45 wherein said matrix is selected from the group consisting of polypropylene, polyester, nylon, cotton, hemp, rayon fibers and polyurethane foam, polyester foam and polyester foam.

47. The method defined in claim 46 wherein said quaternary ammonium compound has the general formula $C_{8-18}$ alkyl dimethyl benzyl ammonium chlorides and mixtures thereof.

48. The method defined in claim 46 wherein the matrix is polypropylene and said treatment solution comprises between about 25% and 60% propylene glycol, between 5% and 25% nonionic surfactant, and up to 45% quaternary ammonium compound having the general formula:

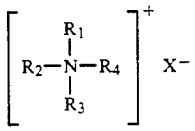

wherein $R_1$ and $R_2$ are alkyl groups having 1-3 carbon atoms; $R_3$ is an alkyl benzyl group where the alkyl group has 6-22 carbon atoms; $R_4$ is polypropylene oxide group.

49. The method defined in claim 45 wherein the matrix is cellulosic and said treatment solution is up to 60% of propylene glycol, 5 to 25% of a nonionic surfactant, between 40% and 60% of a quaternary ammonium compound having the general formula:

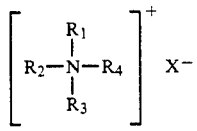

wherein $R_1$ and $R_2$ are alkyl groups having 1-3 carbon atoms; $R_3$ is an alkyl benzyl group where the alkyl group has 6-22 carbon atoms; $R_4$ is a propylene oxide group.

50. The method defined in claim 45 wherein the matrix is comprised of a layer of cellulose fibers sandwiched between layers of polypropylene fibers and said treatment solution is up to 60% propylene glycol; 5-25% of nonionic surfactant and between about 40% and 60% of a quaternary ammonium compound having the general formula:

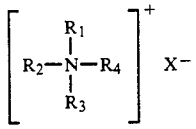

wherein $R_1$ and $R_2$ are alkyl groups having 1-3 carbon atoms; $R_3$ is an alkyl benzyl group where the alkyl group has 6-22 carbon atoms; $R_4$ is a polypropylene oxide group.

51. The method defined in claim 46 wherein the quaternary ammonium chloride is N-alkyl dimethyl benzyl ammonium chloride wherein the alkyl groups comprise about 67%, $C_{12}$, 25% $C_{14}$, 7% $C_{16}$, and 1% $C_8$, $C_{10}$, $C_{18}$.

52. The method defined in claim 46 wherein the quaternary ammonium chloride is N-alkyl dimethyl benzyl ammonium chloride wherein the alky groups comprise about 60% $C_{14}$, 30% $C_{16}$, 5% $C_{12}$, 5% $C_{18}$ and N-alkyl dimethyl ethyl benzyl ammonium chloride wherein the alkyl groups comprise about 68% $C_{12}$ and about 32% $C_{14}$.

53. The substantially flexible dry matrix made in accordance with the method defined in claim 1 to which no water has been added other than that naturally present therein, said matrix possessing antimicrobial properties, said matrix comprising (a) natural or synthetic woven, non-woven or knitted fibers, or (b) flexible foam material or combinations thereof containing an amount of a non-aqueous treatment solution sufficient to allow said matrix to retain its substantially flexible dry characteristics and its antimicrobial characteristics said non-aqueous treatment solution comprising by weight between about 25% and 75% of at least one glycol compound and between about 0.2% and 60% of a cationic surfactant, and antimicrobial effective amounts of an antimicrobial or disinfectant compound.

54. The matrix defined in claim 53 which contains up to 45% of nonionic surfactant selected from the group consisting of:

(a) the polyethylene oxide condensates of alkyl and dialkyl phenols, having a straight or branched alkyl group of from about 6 to about 12 carbon atoms, with ethylene oxide, wherein the amount of ethylene oxide present is from about 3 to about 25 moles per mole of alkyl phenol;

(b) the condensation products of aliphatic alcohols with ethylene oxide of the formula $RO(C_2HO)_nH$ and/or propylene oxide of the formula $RO(CH_3H_6))_nH$: wherein either or both R is a straight or branched alkyl group having from about 8 to 22 carbon atoms, and n is 3 to 40; and (c) polyoxyethylene-polyoxypropylene block copolymers.

55. The matrix defined in claim 53 which is formed into an antimicrobial garment.

56. The matrix defined in claim 53 which is formed into an antimicrobial air filter.

57. The matrix defined in claim 53 which is formed into an antimicrobial mat.

58. The matrix defined in claim 53 which is formed into an antimicrobial towel.

* * * * *

UNITED STATES PATENT AND TRADEMARK OFFICE

CERTIFICATE OF CORRECTION

PATENT NO. : 5,091,102
DATED : February 25, 1992
INVENTOR(S) : CHISTOPHER H. SHERIDAN It is certified that error appears in the above-indentified patent and that said Letters Patent is hereby corrected as shown below:

Claim 1, column 23, line 12, after the word 'weight" and before the phrase "of a cationic surfactant"add -- of at least one glycol compound and between about 0.2% and 60% by weight --.

Signed and Sealed this

Eighteenth Day of February, 1997

*Attest:*

*Attesting Officer*

BRUCE LEHMAN

*Commissioner of Patents and Trademarks*